US005155504A

United States Patent [19]

Oikawa

[11] Patent Number: 5,155,504

[45] Date of Patent: Oct. 13, 1992

[54] THERMAL INK JET PRINTING APPARATUS

[75] Inventor: Shinro Oikawa, Tokyo, Japan

[73] Assignee: NEC Corporation, Tokyo, Japan

[21] Appl. No.: 734,981

[22] Filed: Jul. 24, 1991

[30] Foreign Application Priority Data

Jul. 24, 1990 [JP] Japan ..... 2-195614

[51] Int. Cl.[5] ..... B41J 2/05

[52] U.S. Cl. ..... 346/140 R; 346/75

[58] Field of Search ..... 346/140 R, 75, 76 PH, 346/76 R

[56] References Cited

U.S. PATENT DOCUMENTS

| | | | |
|---|---|---|---|
| 3,834,301 | 9/1974 | Croquelois et al. | 101/1 |
| 4,623,906 | 11/1986 | Chandrashekhar | 346/140 R |
| 4,679,058 | 7/1987 | Hori | 346/140 R |
| 4,725,860 | 7/1988 | Kohyama et al. | 346/140 R |
| 4,751,534 | 6/1988 | Elrod et al. | 346/140 R |

*Primary Examiner*—Benjamin R. Fuller
*Assistant Examiner*—Victor DeVito
*Attorney, Agent, or Firm*—Sughrue, Mion, Zinn, Macpeak & Seas

[57] ABSTRACT

A thermal ink jet printing apparatus has a film having a number of small apertures formed in the front thereof and retaining liquid ink in the apertures. The film is located to face a thermal head having heating elements. As the heating elements are selectively energized in response to a signal representative of a particular image pattern, the ink in the apertures evaporates to exert a pressure on the ink. As a result, the ink is ejected toward a recording medium to form an image thereon. An ink retaining layer is provided on the rear of the film and communicated to the apertures. Alternatively, an ink well may be formed in a portion of the thermal head that faces the rear of the film and communicated to the apertures.

6 Claims, 4 Drawing Sheets

THERMAL INK JET PRINTING APPARATUS

BACKGROUND OF THE INVENTION

The present invention relates to a thermal ink jet printing apparatus.

A thermal ink jet printing apparatus has been proposed in various forms in the past. One of conventional ink jet printing apparatuses uses a film which is formed with a number of small apertures for retaining liquid ink therein. While such a film runs in contact with a thermal head, the ink is ejected from the film to form an image on a recording medium. Specifically, heating elements included in the thermal head are selectively energized by an electric signal representive of a particular image pattern. Heat generated by each energized heating element causes, among various components constituting the ink, the components having low boiling points to evaporate to thereby form a bubble. The ink is ejected from the apertures of the film by the pressure of the bubble to reach a recording medium which is spaced apart from the film by a small gap, thereby forming a spot on the recording medium. In this type of apparatus, when the apertures for forming a single ink spot corresponding to a single heating element are arranged in a density higher than the recording density, a single spot is formed by a plurality of ink drops having been ejected from nearby apertures. Hence, even when some of the apertures are sopped up and unable to eject ink therefrom, they do not have critical influence on the result of printing, i.e., a spot without the local omission of dots is achievable. This type of ink jet printing apparatus is disclosed in, for example, U.S. Pat. No. 4,608,577 (Hori).

However, the above-described type of conventional thermal ink jet printing apparatus has some problems left unsolved, as follows. Since a single ink spot corresponding to a single heating element is constituted by a plurality of ink drops ejected from the apertures of the film, it is difficult for the ink drops to cover the entire area of the spot due to the short amount of ink drops. More specifically, the ink spot is the collection of a plurality of physically separate pixels, resulting in low image density.

The film may be held in contact with a recording medium in the event of printing in order to prevent the sharpness of the ink spots from being lowered by the scattering of ink drops, as also proposed in the past. The prerequisite with this kind of scheme is that the front of the film and the walls of the apertures be repulsive to ink. In this case, however, the amount of ink on the recording medium is further reduced since the apertures of the film are not filled with ink.

SUMMARY OF THE INVENTION

It is therefore an object of the present invention to provide a thermal ink jet printing apparatus capable of printing a high density clear-cut image on a recording medium by reducing the scattering of ink drops.

It is another object of the present invention to provide a generally improved thermal ink jet printing apparatus.

In accordance with the present invention, in a thermal ink jet printing apparatus comprising a film formed with a number of small apertures in the front thereof, the apertures each being filled with liquid ink, and a thermal head located to face the rear of the film, the ink being ejected from the apertures of the film to form an image on a recording medium which faces the front of the film, ink retaining means for retaining the ink is positioned at the interface between the rear of the film and the head.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
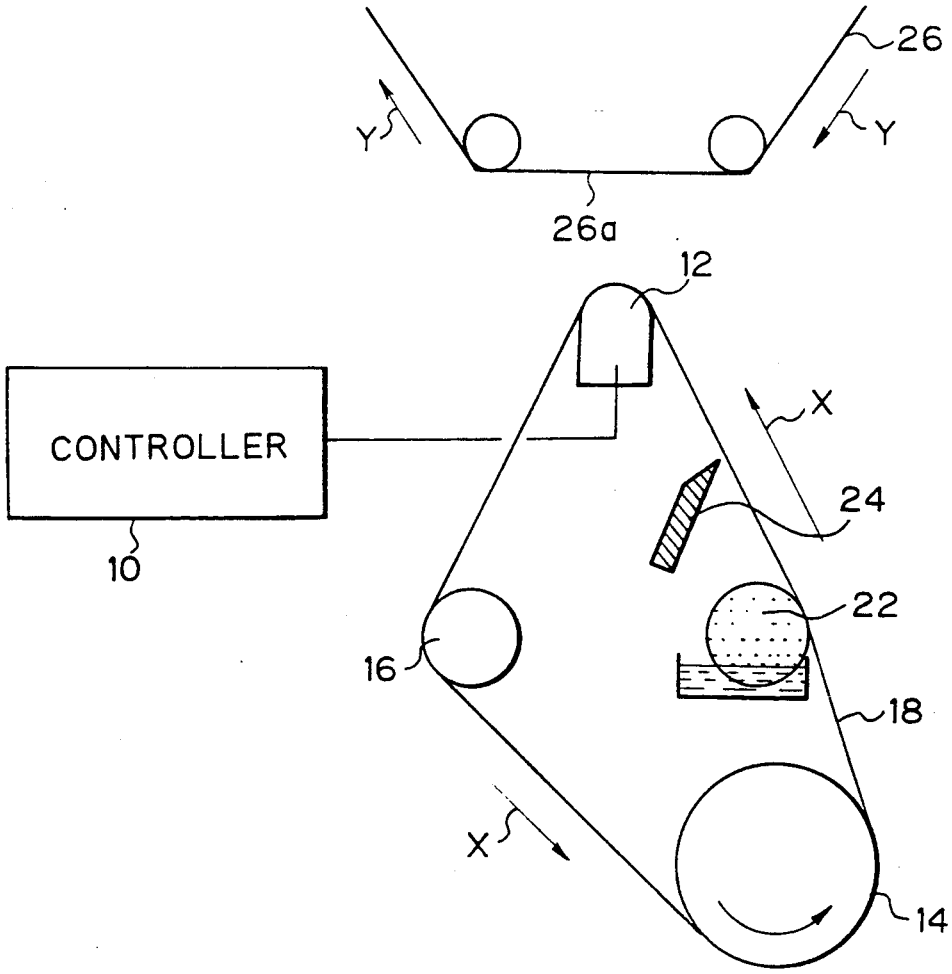
Fig. 1 PRIOR ART
FIG. 1 is a view showing the general construction of a conventional thermal ink jet printing apparatus.

To better understand the present invention, a brief reference will be made to a prior art thermal ink jet printing apparatus, shown in FIG. 1. As shown, the apparatus includes a controller 10 and a thermal head 12 responsive to a signal S which is fed from the controller 10 and representive of an image pattern to be recorded. An endless film 18 is passed over the thermal head 12, a drive roller 14, and a tension roller 16 and driven by the drive roller 14 to run in a direction indicated by an arrow X in the figure. An inking roller 22 supplies liquid ink 20 to the film 18. A blade 24 is held in contact with the rear or inner surface of the film 18 to regulate the thickness of the ink layer supplied to the film 18. A recording medium in the form of a sheet 26 is transported in a direction Y with the recording surface **26*a* thereof facing the thermal head 12**.

Figure 2A:
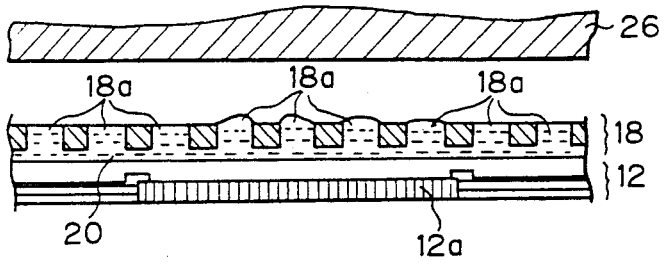
Fig. 2A PRIOR ART
FIGS. 2A-2D show a thermal head and a film included in the conventional apparatus and a printing process effected thereby.

As shown in FIG. 2A, the endless film 18 has a number of apertures **18*a* each being filled with the ink 20 supplied from the inking roller 22. The head 12 includes a heating element 12*a*. It should be noted that the heating element 12*a* is one of numerous heating elements included in the head 12**.

Figure 2B:
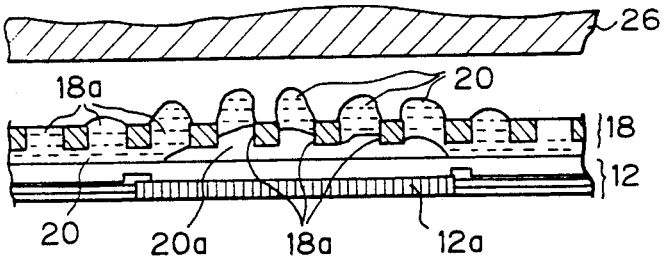
Fig. 2B PRIOR ART
Figure 2C:
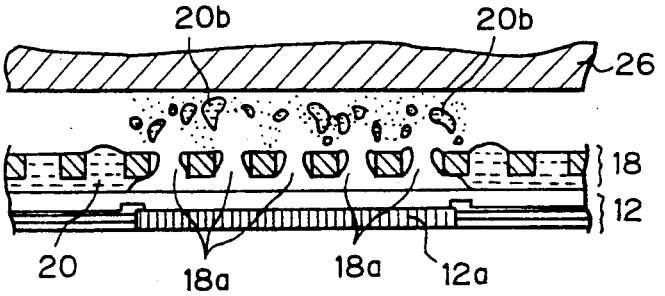
Fig. 2C PRIOR ART
Figure 2D:
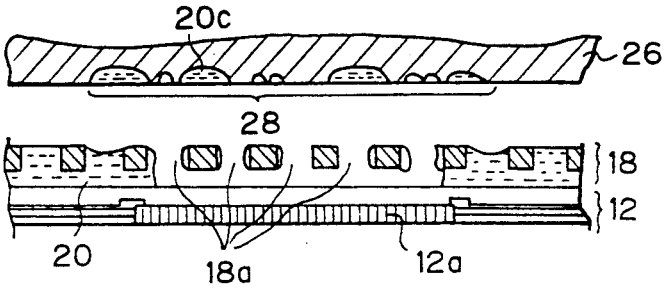
Fig. 2D PRIOR ART

A reference will be made to FIGS. 2A through 2D for describing a printing process practicable with the conventional film 18. As shown in FIG. 2A, while the film 18 retaining the ink 20 in the apertures **18*a* thereof runs in contact with the thermal head 12, the signal S representive of a particular image pattern is fed to the thermal head 12 to energize the heating element 12*a*. Heat generated by the heating element 12*a* causes, among various components constituting the ink 20, the components having low boiling points to evaporate in the apertures 18*a* and to thereby form a bubble 20*a*. By the pressure of the bubble 20*a*, the ink 20 is ejected from the apertures 18*a*, as shown in FIG. 2B. The resulted ink drops 20*b* fly toward the recording medium 26, as shown in FIG. 2C. As a result, the ink drops 20*b* form a single ink spot on the recording medium 26 in combination, as shown in FIG. 2D. Hence, the ink spot 28 formed on the recording medium 26 is the collection of a plurality of ink drops 20*c*. It follows that when the amount of ink drops 20*b* deposited on the recording medium 26 is short the ink drops 20*b* fail to fully cover the entire area of one spot 28 and thereby reduces the density of the entire spot 28**.

Preferred embodiments of the present invention free from the above drawbacks will be described hereinafter. Since the embodiments are similar in general construction to the conventional apparatus shown in FIG. 1, the same reference numerals will be used to designate the same components.

Referring to FIGS. 3A through 3D, a preferred embodiment of the present invention is shown which differs from the conventional apparatus regarding the structure of the endless film. Specifically, as shown in FIGS. 3A through 3D, an endless film 18A has not only a number of apertures 18*a* but also an ink retaining layer 18*b* which is implemented as a piece of woven cloth affinitive to ink. The ink retaining layer 18*b* is formed on the rear of the film 18A, i.e., the surface of the film 18A that contacts the thermal head 12.

Figure 3A:
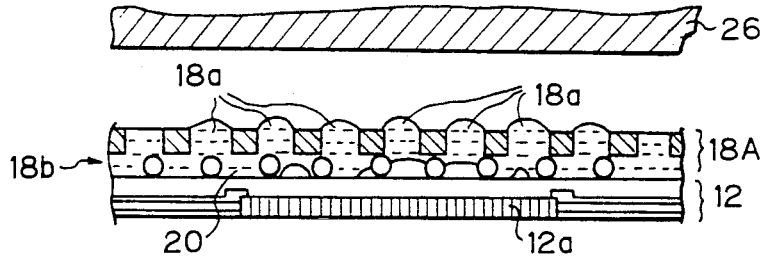
FIGS. 3A-3D show a thermal head and a film representative of a preferred embodiment of the present invention and a printing process particular thereto.
Figure 3B:
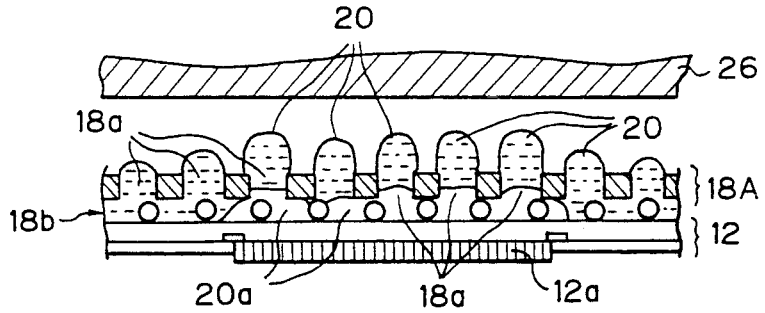
Figure 3C:
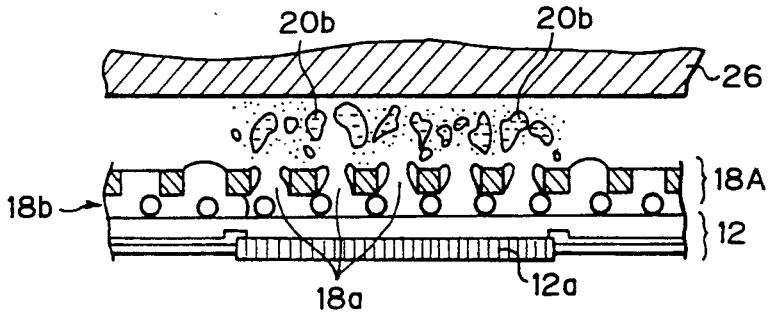
Figure 3D:
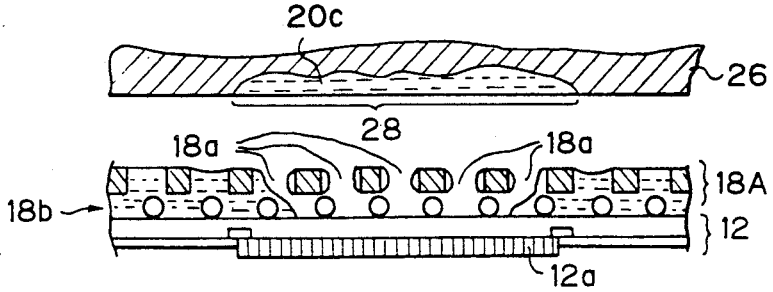

In operation, the inking roller 22 shown in FIG. 1 supplies the ink 20 to the ink retaining layer or woven cloth 18*b* of the film 18A affinitive to ink. The blade 24 forces the ink 20 into the cloth 18*b* and apertures 18*a*, as shown in FIG. 3A. The film 18A retaining the ink 20 therein is brought into contact with the thermal head 12 which is located at a predetermined print position. As the heating element 12*a* of the head 12 is energized by the signal S fed from the controller 10 the resulted heat causes the components of the ink 20 having low boiling points to evaporate at the interface between the cloth 18*b* and the aperatures 18*a*. As a result, a bubble 20*a* is produced to eject the ink 20 from aperatures 18*a* by the pressure thereof, as shown in FIG. 3B. Ink drops 20*b* resulted from ejected ink 20 reach a recording medium 26, as shown in FIG. 3C. Such ink drops 20*b* are deposited on the recording medium 26 to form a single ink spot 28 while covering the entire area of the ink spot 28, as shown in FIG. 3D. In this manner, not only the ink 20 filled in the numerous apertures 18*a* but also the ink filled in the cloth 18*b* forms the ink drops 20*b* and reaches the recording medium 26. Consequently, a sufficient amount of ink 20 is deposited on the recording medium 26 to free the spot 28 from the local omission of dots, thereby insuring high image density.

In the illustrative embodiment, the front of the film 18A may be provided with repulsiveness to ink to increase the contact angle between the ink 20 and the inner walls of the apertures 18*a*. Then, the direction of ink ejection will be stabilized to reduce the scattering of ink drops 20*b*. This is successful in enhancing the sharpness of the spot 28 and, therefore, in producing a clear-cut image. If desired, not only the front of the film 18A but also the inner walls of the apertures 18*a* may be provided with repulsiveness to ink, and the film 18A may be held in contact with the recording medium 26. This reduces the contamination of the background area as well as the scattering of inks drops 20*b*, enhancing the sharpness of the spot 28.

It should be noted that the ink holding layer 18*b* provided on the rear of the film 18A and affinitive to ink may be implemented as a member physically independent of the film 18A.

Referring to FIGS. 4A through 4D, an alternative embodiment of the present invention will be described. As shown, this embodiment has a thermal head 12A which is provided with an ink well 12*b* in the surface thereof and in a position corresponding to the heating element 12*a*.

Figure 4A:
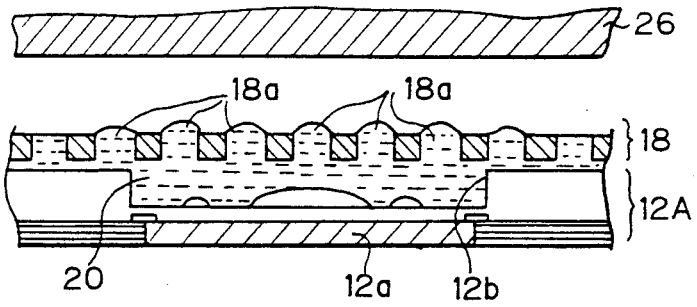
FIGS. 4A-4D are views similar to FIGS. 3A-3D, showing an alternative embodiment of the present invention.
Figure 4B:
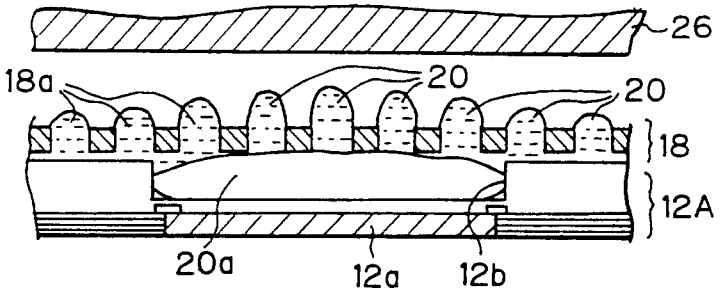
Figure 4C:
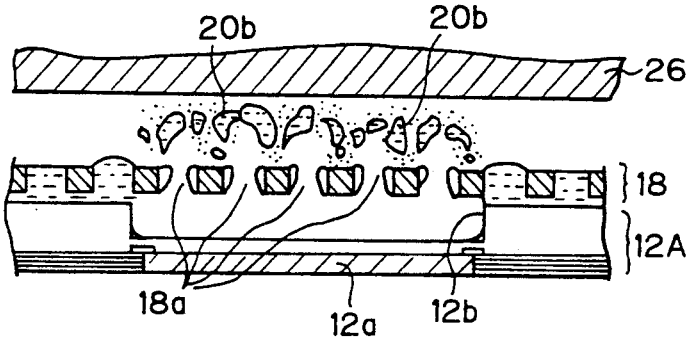
Figure 4D:
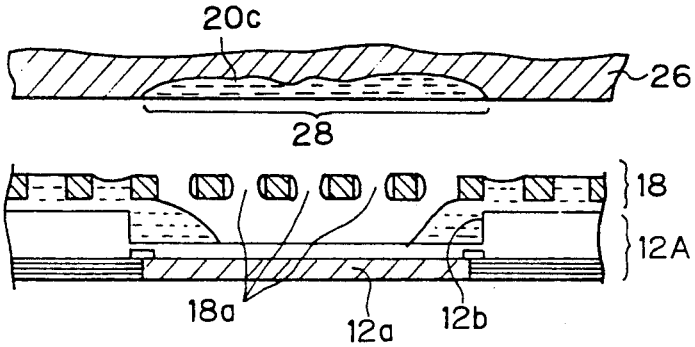

In operation, the inking roller 22 shown in FIG. 1 supplies the ink 20 to the film 18. The ink 20 is regulated to a predetermined thickness by the blade 24 while being forced into the apertures 18*a*. As the film 18 retaining the ink 20 therein contacts the surface of the thermal head 12A which is located in a predetermined print position, the ink 20 flows from the film 18 into the ink well 12*b* of the head 12A to thereby fill the well 12*b*, as shown in FIG. 4A. When the heating element 12*a* of the head 12 is energized by the signal S representive of a particular image pattern, the components of the ink 20 having low boiling points evaporate in the apertures 12*a* to produce a bubble 20*a*, as shown in FIG. 4B. As a result, the ink 20 is ejected from the apertures 18*a* by the pressure of the bubble 20*a*. As shown in FIG. 4C, drops 20*b* resulted from the ejected ink 20 reach the recording medium 26 to form a single spot 28, as shown in FIG. 4D. The drops 20*b* cover the entire area of the spot 28, as in the previous embodiment. As stated above, in this embodiment, not only the ink 20 filled in the apertures 18*a* of the film 18 but also the ink 20 filled in the ink well 12*b* of the head 12A is ejected via the apertures 18*a*. The resulted spot 28 on the recording medium is free from the local omission of dots, as shown in FIG. 4D. This embodiment is, therefore, also successful in insuring high image density.

While the illustrative embodiment assigns a single ink well 12*b* to each heating element 12*a*, the ink well 12*b* may be implemented as an elongate recess or channel, if desired. Experiments showed that when the heating element 12 is sized 130×110 micrometers and the channel is 250 micrometer wide and 50 micrometer deep, the resultant spot has an about three times higher density than a spot obtainable with the conventional apparatus shown in FIGS. 2A through 2D.

Again, the front of the film 18 may be provided with repulsiveness to ink to increase the contact angle between the ink 20 and the inner walls of the apertures 18*a*. Then, the direction of ink ejection will be stabilized to reduce the scattering of ink drops 20*b*. This is successful in enhancing the sharpness of the spot 28 and, therefore, in producing a clear-cut image. If desired, not only the front of the film 18 but also the inner walls of the apertures 18*a* may be provided with repulsiveness to ink, and the film 18 may be held in contact with the recording medium 26. This reduces the contamination of the background area as well as the scattering of ink drops 20*b*, enhancing the sharpness of the spot 28.

Various modifications will become possible for those skilled in the art after receiving the teachings of the present disclosure without departing from the scope thereof.

What claimed is:

1. A thermal ink jet printing apparatus comprising: a film with a number of small aperatures formed on a front surface thereof, said apertures each being filled with liquid ink, a thermal head located to face a rear surface of said film, said ink being ejected from said apertures of said film to form an image on a recording medium which faces the front surface of said film, and a hollow forming an ink well in a portion of said thermal head which faces the rear surface of said film, said hollow provided to temporarily store ink supplied from said film.

2. An apparatus as claimed in claim 1, wherein an ink retaining layer is provided on a rear portion of said film for retaining ink to be supplied to said apertures.

3. An apparatus as claimed in claim 2, wherein said ink retaining layer comprises a piece of woven cloth with an affinity to ink 4. An apparatus as claimed in claim 1, wherein the front surface of said film is repulsive to ink.

5. An apparatus as claimed in claim 1, wherein side walls of said apertures of said film are repulsive to ink.

6. An apparatus as claimed in claim 1, wherein said thermal head comprises a heating element facing said hollow.

* * * * *